US011846155B2

(12) United States Patent
Kjeldby

(10) Patent No.: US 11,846,155 B2
(45) Date of Patent: Dec. 19, 2023

(54) RISER SURGE PROTECTION SYSTEM

(71) Applicant: EQUINOR ENERGY AS, Stavanger (NO)

(72) Inventor: Tor Kindsbekken Kjeldby, Stavanger (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 17/794,162

(22) PCT Filed: Jan. 12, 2021

(86) PCT No.: PCT/NO2021/050009

§ 371 (c)(1),
(2) Date: Jul. 20, 2022

(87) PCT Pub. No.: WO2021/150118

PCT Pub. Date: Jul. 29, 2021

(65) Prior Publication Data

US 2023/0101329 A1 Mar. 30, 2023

(30) Foreign Application Priority Data

Jan. 21, 2020 (GB) ..... 2000868

(51) Int. Cl.
*E21B 17/01* (2006.01)
*E21B 34/00* (2006.01)

(52) U.S. Cl.
CPC ..... *E21B 34/00* (2013.01); *E21B 17/01* (2013.01)

(58) Field of Classification Search
CPC ..... E21B 17/01; E21B 17/015
See application file for complete search history.

(56) References Cited

U.S. PATENT DOCUMENTS

| | | | | |
|---|---|---|---|---|
| 8,985,217 | B2 * | 3/2015 | McCann | E21B 47/047 166/336 |
| 2013/0098629 | A1 * | 4/2013 | Wilson | E21B 43/13 166/372 |
| 2016/0177666 | A1 * | 6/2016 | Van Dam | F16K 31/26 166/250.15 |

FOREIGN PATENT DOCUMENTS

| | | | | |
|---|---|---|---|---|
| CA | 3 078 694 | A1 | 4/2019 | |
| GB | 2567514 | A | 4/2019 | |
| WO | WO-2011073203 | A1 * | 6/2011 | B01D 19/0031 |
| WO | WO 2012/095196 | A2 | 7/2012 | |

OTHER PUBLICATIONS

International Search Report for PCT/NO2021/050009 dated Mar. 9, 2021.

(Continued)

*Primary Examiner* — Matthew R Buck
(74) *Attorney, Agent, or Firm* — Birch, Stewart, Kolasch & Birch, LLP

(57) ABSTRACT

A system for liquid surge protection of a subsea riser having a horizontal portion on the seabed and a sag bend portion includes: a flexible tubing having a top end and a bottom end; a plurality of autonomous valves configured to permit liquid to pass through into the flexible tubing, wherein the autonomous valves are arranged between the top end and the bottom end of the tubing; and an inlet device coupled to the bottom end of the flexible tubing, wherein said inlet device is biased against a bottom wall the riser.

16 Claims, 8 Drawing Sheets

(56) References Cited

OTHER PUBLICATIONS

United Kingdom Examination Report and Notification of Intention to Grant under Section 18(4), issued in Priority Application No. 2000868.6, dated Jul. 29, 2021.
United Kingdom Search Report, issued in Priority Application No. 2000868.6, dated Mar. 25, 2020.
Written Opinion of the International Searching Authority for PCT/NO2021/050009 (PCT/ISA/237) dated Mar. 9, 2021.

* cited by examiner

RISER SURGE PROTECTION SYSTEM

TECHNICAL FIELD

The invention relates to controlling the flow of hydrocarbons in a riser, and in particular to riser surge protection.

BACKGROUND

A hydrocarbon producing flowline can be connected to a riser which transports gas and liquids from a well to a production facility. In many subsea systems, flexible risers are used. In this way, the riser is capable of withstanding horizontal and vertical movement, for example, due to wave motion. Several different configurations of flexible risers are known in the art (e.g. lazy wave, lazy-S, steep-S etc.). In each configuration, the riser is typically curved to form at least one sag bend (i.e. 'U' shaped) and at least one hog bend (i.e. an inverted 'U' shape). As such, the riser will not only extend upwards continually from the flowline in a straight way, but will have several areas with bends, local dips and near-horizontal regions.

A problem with flexible riser systems is that they may be prone to liquid accumulation in the bends or dips. At some point, the accumulated liquid may start to flow towards a riser base in an unstable manner, giving rise to liquid accumulation at the riser base, liquid accumulation along the inside walls of the riser, and pulsating liquid production at the platform. This is known as liquid surging. At some point, liquid surging may become so severe that overfilling of separators can occur, which in turn causes problems for processing plants and may ultimately make it necessary to abandon the flowline. Therefore, there is a need for a system which can mitigate the problem of liquid accumulation in a flexible riser, and thereby reduce the risk of a liquid surge.

SUMMARY

According to a first aspect of the invention, there is provided a system for liquid surge protection of a subsea riser having a horizontal portion on the seabed and a sag bend portion, the system comprising: a flexible tubing having a top end and a bottom end; a plurality of autonomous valves configured to permit liquid to pass through into the flexible tubing; wherein the autonomous valves are arranged between the top end and the bottom end of the tubing; and further comprising an inlet device coupled to the bottom end of the flexible tubing, wherein said inlet device is biased against a bottom wall the riser.

The plurality of autonomous valves may be arranged at a plurality of locations along the circumferential direction of the flexible tubing. Optionally, plurality of autonomous valves may be arranged at a plurality of locations along the longitudinal direction of the flexible tubing.

The plurality of autonomous valves may be provided within a wall of the flexible tubing. Alternatively, the plurality of autonomous valves may be provided within a wall of one or more rigid supporting bodies attached to the flexible tubing. Each of the one or more rigid supporting bodies may have a curved shape which matches the inner curvature of the riser.

When the riser has a second sag bend portion, the system may further comprise a second plurality of autonomous valves configured to permit liquid to pass through into the flexible tubing, wherein the second plurality of autonomous valves are arranged so as to be located in said second sag bend.

The system may further comprise a pressure control system arranged to create a pressure differential between the riser and the flexible tubing.

The top end of the riser may be connected to a first separator and the top end of the flexible tubing may be connected to a second separator, wherein the second separator has a lower pressure than the first separator.

In use, the bottom end of the tubing may be in the horizontal portion of the riser, while said autonomous valves are located in the sag bend portion.

Optionally, the system may further comprise a spacer or a weight arranged to urge the inlet device against the bottom wall of the riser. The inlet device may have a curved shape which matches the inner curvature of the riser.

The system may further comprise a reel for unreeling the flexible tubing to extend said flexible tubing into the riser.

According to a second aspect of the invention, there is provided a method for liquid surge protection of a subsea riser having a horizontal portion on the seabed and a sag bend portion, the method comprising: providing a flexible tubing having a top end and a bottom end; providing a plurality of autonomous valves between said top end and bottom end, each valve arranged to permit liquid to pass through into the flexible tubing; extending the flexible tubing into the riser such that the bottom end is in the horizontal portion of the riser and said autonomous valves are located in the sag bend portion; and extracting liquid from the riser through the bottom end of the tubing and the plurality of autonomous valves.

Optionally, before extracting liquid from the riser through the bottom end of the tubing and the plurality of autonomous valves, the method further comprises creating a pressure differential between the riser and the flexible tubing.

DETAILED DESCRIPTION

Figure 1:
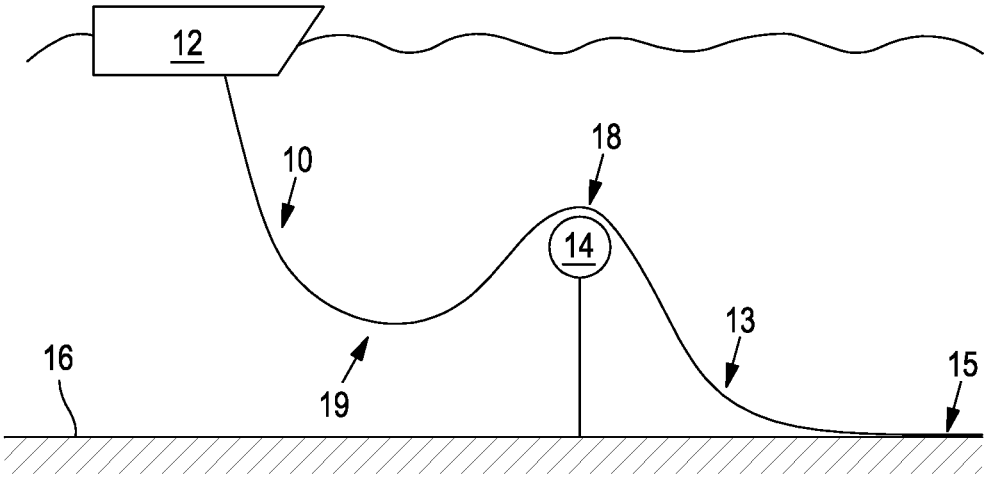
FIG. 1 illustrates an example subsea flexible riser system.

FIG. 1 illustrates a typical 'lazy-S' configuration of a subsea riser, wherein the riser 10 is curved in an 'S' shape over an anchored buoyancy module 14, between the seabed 16 and a floating facility 12. In this configuration, the riser 10 forms a hog bend 18 (inverted 'U' shaped) over the buoyancy module 14, and a sag bend 19 ('U' shaped) between the buoyancy module 14 and floating facility 12. A further sag bend 13 is formed between the hog bend 18 and the horizontal portion 15 of the riser, which lies on the seabed 16.

A problem with flexible riser systems in a gas production system is that they may be prone to liquid accumulation. In horizontal, near-horizontal or low portions of the riser, the fluid velocity is typically low, and the fluids may naturally stratify under the influence of gravity. For example, flowing oil and/or water phases may be separated from the gas phase by gravity in the horizontal, seabed portion 15 of the riser. Moreover, even if this liquid phase is extracted from the horizontal portion 15, fluid stratification may still occur further downstream e.g. in and around the local minimum of the sag bend 19. The problem exists therefore that liquid accumulation can occur in multiple different parts of the riser 10, increasing the risk of liquid surging.

The inventors have realised that the above problem can be solved by extending a flexible tubing in to the riser, and allowing liquid to pass into said tubing in two different ways: firstly via an opening at the bottom end of the flexible tubing; and secondly via a plurality of autonomous valves provided at locations along the length of the tubing. Generally, autonomous valves are self-controlled and are able to selectively open or close depending on the fluids which come in to contact with the valves. Some autonomous valves utilise the Bernoulli Effect acting on a freely moveable body situated at a valve seat, arranged with a flow path through the valve as to "invert" the response compared to a conventional valve. In this way, they can be designed such that they let liquid through but close when the gas content increases above a predetermined level. Typically, autonomous valves are usually used downhole to control the inflow of production fluids, but the inventors have realised that they may be used in the different context (i.e. riser surge mitigation) of the present application. In particular, the autonomous valves in embodiments described herein may be valves configured to let liquid (e.g. water, oil) through into the flexible tubing, but which close at when the fluid flow is primarily gaseous. The design parameters for a particular autonomous valve with these properties will be known, as such, to the skilled person but the use to solve the problem identified by the inventors is not known to the skilled person.

Figure 2A:
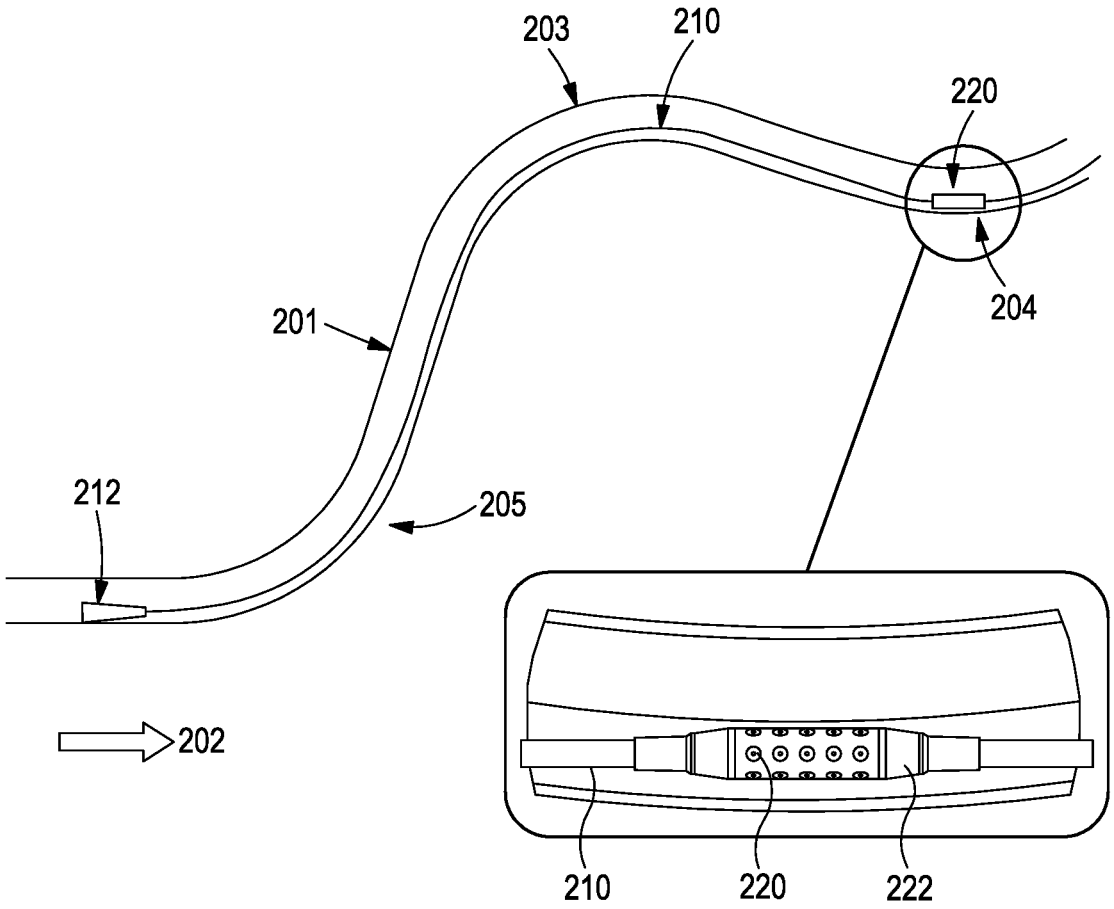
FIGS. 2A and 2B illustrate a riser surge protection system according to embodiment of the inventions.

FIG. 2A shows a riser surge protection system, according to an embodiment of the invention, wherein a portion of a riser 201 is illustrated. The upstream end of the riser 201 may be connected to a hydrocarbon producing flowline. Alternatively, the flowline and riser may both be part of a single tubular, whereby the part of the tubular which extends upwards towards the surface is referred to as the riser. In either case, the upstream end of the riser 201 lies on the seabed, forming a horizontal (or near-horizontal) portion, and the riser 201 transports fluids in a downstream direction 202 towards a production facility. The riser 201 curves up from the seabed and over into a hog bend 203 and a sag bend 204. From the sag bend 204, the riser 201 curves upwards towards the surface. This curved 'S'-like shape may be formed by arranging the riser 201 over a buoyancy aid or subsea arch (not shown). It can be seen that in the sag bend 204 a local minimum in curvature is formed, and around said local minimum the riser 201 is near-horizontal. As such, a stratified flow (rather than e.g. a mist flow) may occur in this region.

The flexible tubing 210, which is e.g. coiled tubing, terminates at in the horizontal portion of the riser 201 which lies on the seabed. In other words, the tubing 210 is arranged such that the bottom end of the tubing 210 is in the horizontal portion. In the embodiment shown in FIG. 2A, an inlet device 212 is connected to the bottom end of the tubing 210. The inlet device 212 is for extracting a liquid from a stratified fluid flow in the horizontal, seabed portion of the riser into the flexible tubing 210. The design of the inlet device 212 is configured to capture liquid flowing in the downstream direction 202, as discussed in more detail below.

A plurality of autonomous valves 220 are provided to allow liquid to be extracted at locations along the length of the tubing 210. The autonomous valves may be any suitable autonomous valves known in the art which are configured to let liquid (e.g. water, oil) through, but which close at when the fluid flow is primarily gaseous. In the example shown in FIG. 2A, the autonomous valves 220 are arranged to allow liquid to pass through into the flexible tubing approximately in the local minimum of the sag bend 204. In this way, any liquid accumulating or flowing into the sag bend 204 can be extracted.

The autonomous valves 220 may be provided within the walls of a rigid supporting body 222, as shown in the zoomed-in portion of FIG. 2A. In this case, the supporting body 222 has a tubular shape, and the autonomous valves 220 are distributed uniformly along the length and around the circumference of the tubular. In other embodiments, the autonomous valves 220 are instead provided within the wall of the flexible tubing 210 itself.

The portion of flexible tubing 210 connecting the inlet device 212 and supporting body 222 is a suitable length such that when the inlet device 212 is in the horizontal, seabed portion of the riser 210, the supporting body 222 is positioned approximately at the lowest point of the sag bend. During installation, the tubing 210 may be unreeled or otherwise lowered (inlet device 212 end first) down into the riser 201.

Figure 2B:
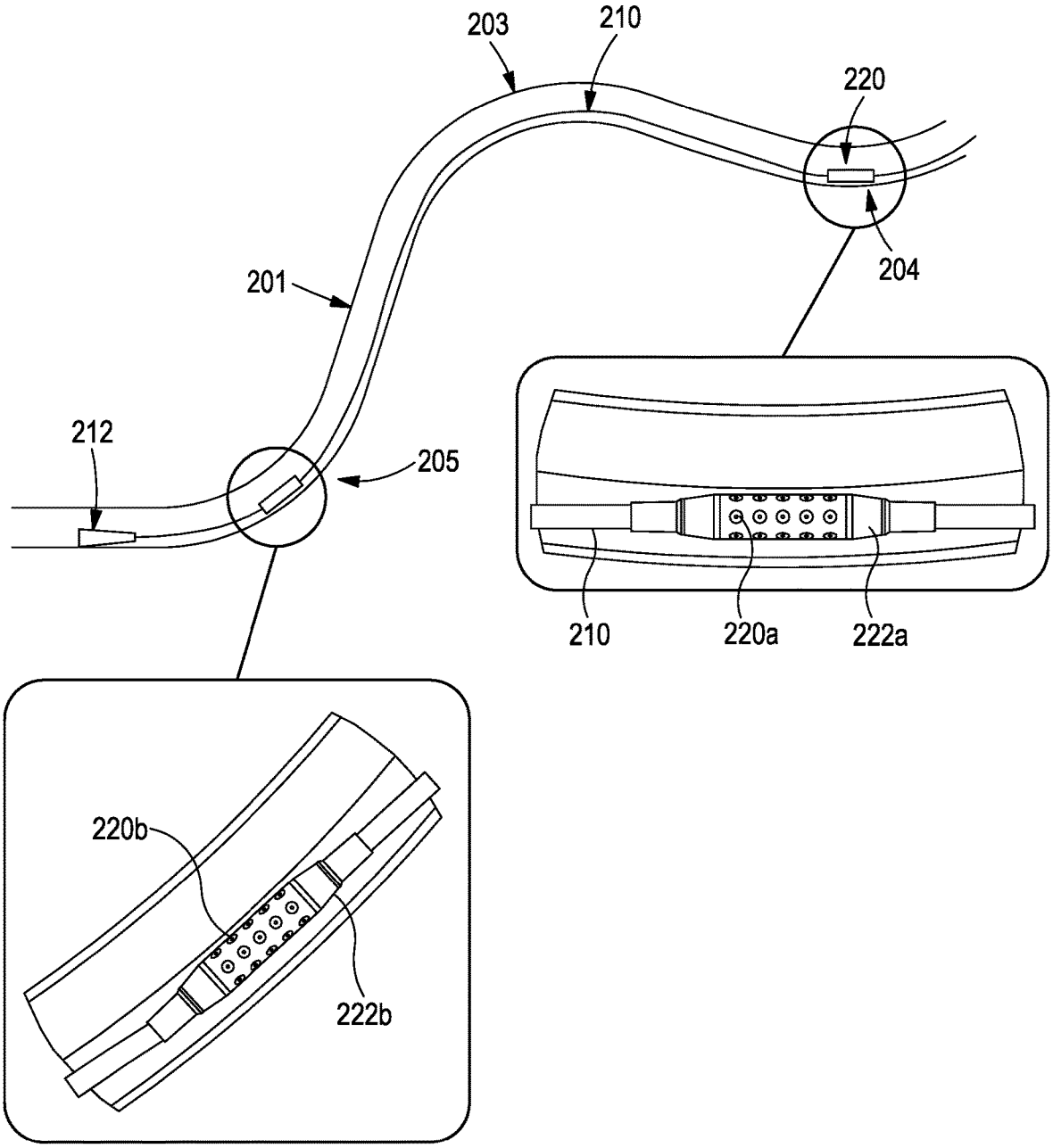

FIG. 2B illustrates an alternative embodiment of the invention, wherein a first group of autonomous valves 220*a* are provided in the sag bend 204 (as with FIG. 2A), and a second group of autonomous valves 220*b* are provided in the first uphill region 205 of the riser 201 (i.e. a further sag bend). First and second rigid supporting bodies 222*a*, 222*b* are provided to support the first and second groups 220*a*, 220*b* of autonomous valves, respectively, as illustrated in the zoomed-in portions. In this way, liquid extraction is enabled in two further regions downstream of the inlet device 212.

In some embodiments, the system further comprises a pressure control system, configured to create a pressure differential between the flexible tubing and the riser. In this way, liquid is drawn from the riser and into the flexible tubing. For example, the pressure control system may comprise a container, which is maintained at a low pressure, e.g. via a regulating valve or a pump, with the top end of the flexible tubing connected to said container.

Figure 3:
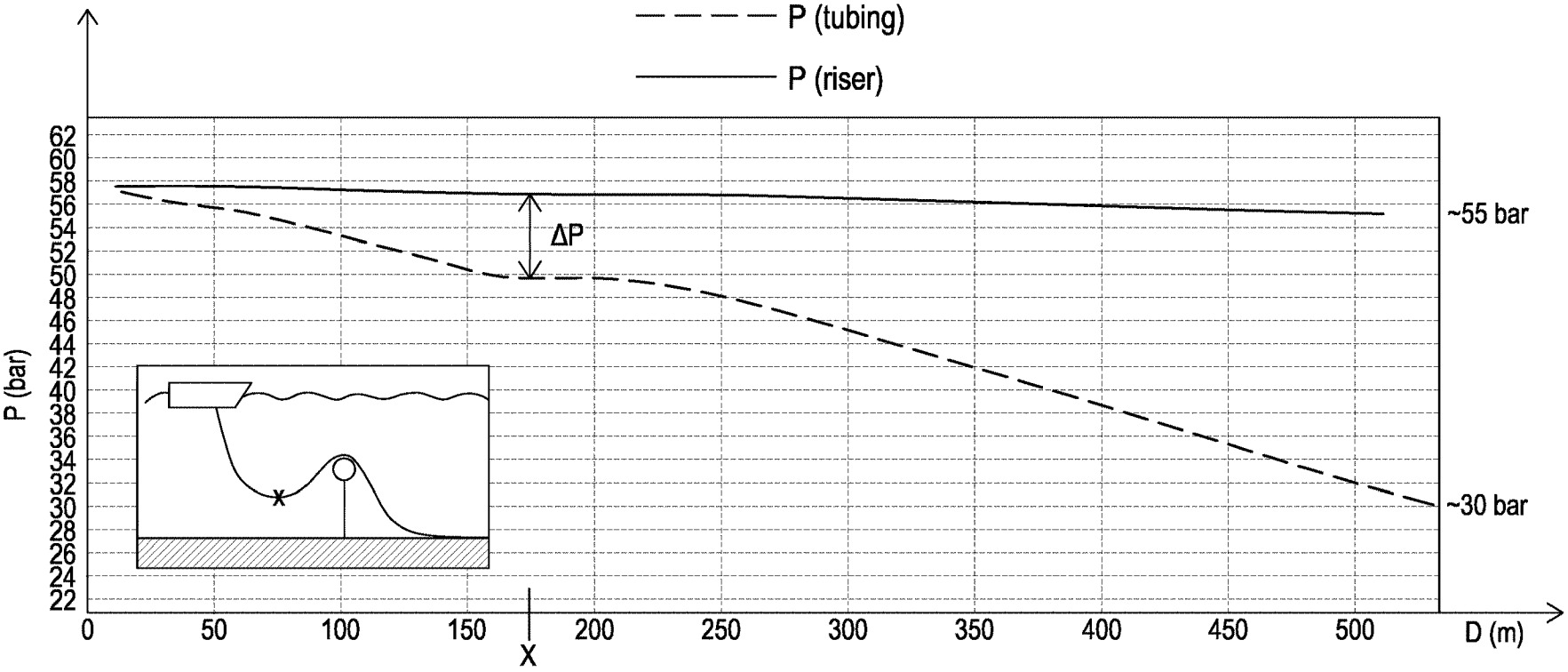
FIG. 3 shows results of a simulation of the system.

FIG. 3 shows results of a simulation of the system e.g. as shown in FIG. 2A, wherein the pressure P along the tubing and riser is plotted against the distance D along the riser. In the simulation, the pressure P at the top end of the tubing is maintained at 30 bar, whereas the pressure in the riser is approximately 55 bar. The position marked 'X' on the graph corresponds to the location of the lowest point in the sag bend, as illustrated in the inset plot. As the bottom end of the tubing is open via the inlet device to the riser, it can be seen that the pressure at the bottom end (i.e. $D \approx 0$) of the tubing is approximately equalised with the riser pressure, while the top end of the tubing is at approximately 30 bar. In this way, a drop in pressure along the tubing is created, and thus a pressure differential between the riser and tubing. At point X, a pressure differential $\Delta P$ of approximately 8 bar is created.

In some embodiments, the autonomous valves are configured such that the fluid flow rate permitted to pass through each valve varies with the pressure differential $\Delta P$ created across the valve. In this way, if the required liquid extraction rate is known (e.g. in $m^3$/day) and a given pressure differential $\Delta P$ in the sag bend is created, the number of valves required to achieve said liquid extraction rate can be estimated. Referring again to FIG. 3, in the simulation, a liquid mass flow of 14 kg/s was taken to be incident on the inlet device at the bottom end of the flexible tubing. The liquid capture efficiency of the inlet device was set as 70%, meaning that a remaining liquid flow rate of 4.2 kg/s reaches the sag bend at point X. Taking the liquid flow rate permitted through each valve as 15 $m^3$/day when $\Delta P$=8 bar (and assuming a density of 1000 kg/$m^3$), it follows that approximately 24 autonomous valves are required in the simulation in order to extract said remaining liquid. It can be seen, therefore, in this example, that a relatively low number of valves are capable of providing sufficient liquid extraction.

It should be understood that the above simulation parameters are by way of example only, to illustrate the concept that an appropriate type and number of autonomous valves to achieve the required liquid removal capacity can be estimated.

In the above-described simulation, at the differential pressure $\Delta P$ of 8 bar, each valve is taken as having a gas flow capacity of 23 $m^3$/day—meaning that the total gas flow through the autonomous valves is estimated as 552 $m^3$/day. It is important to optimise the number of autonomous valves 220. Too few valves 220 will give rise to low liquid removal capacity from the sag bend. If there are too many valves, the gas flow rate being fed from the sag bend into the coiled tubing 210 will be too high as soon as all the liquid has been drained from the sag bend. When the gas rate is too high, the gas will fill up the coiled tubing 210 transport capacity, hence reducing the liquid removal capability of the inlet device 212.

In some embodiments, a plurality of separators are used to create a pressure drop between the riser and the flexible tubing. Typically, a plurality of separators are used in stage separation of hydrocarbons, wherein the first-stage separator, has the highest pressure and the operating pressure is sequentially reduced in each successive separator. The flexible tubing will be able to carry out a suction function if the pressure inside the flexible tubing is lower than the pressure inside the riser. This pressure difference can be achieved by connecting the flexible tubing to a separator that has a lower pressure than the nearest separator to which the riser is connected. In other words, the riser is connected to a first separator and the flexible tubing is connected to a second separator, wherein the second separator has a lower pressure than the first separator. In one example, the riser section is directly connected to a first-stage separator, and the flexible tubing is connected to a second-stage separator. Advantageously, in this way, the pressure difference can be created in the flexible tubing, without requiring any additional apparatus further to the separators already used in the stage separation process.

Figure 4A:
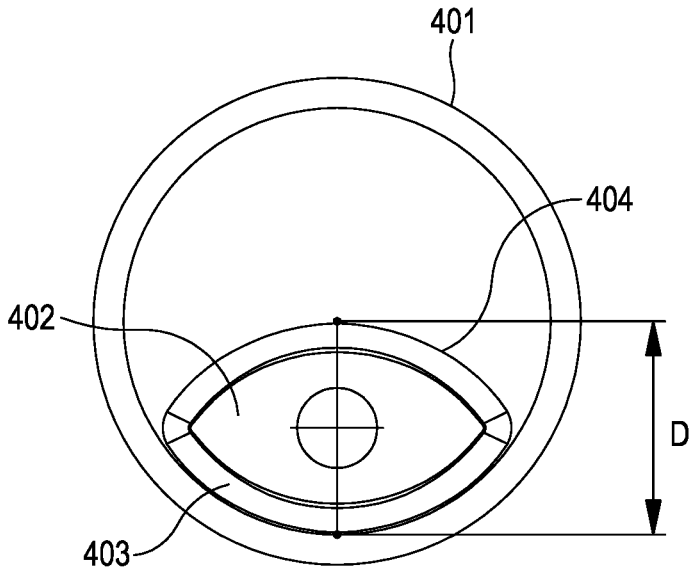
FIG. 4A illustrates a radial cross section through a riser with an inlet device.
Figure 4B:
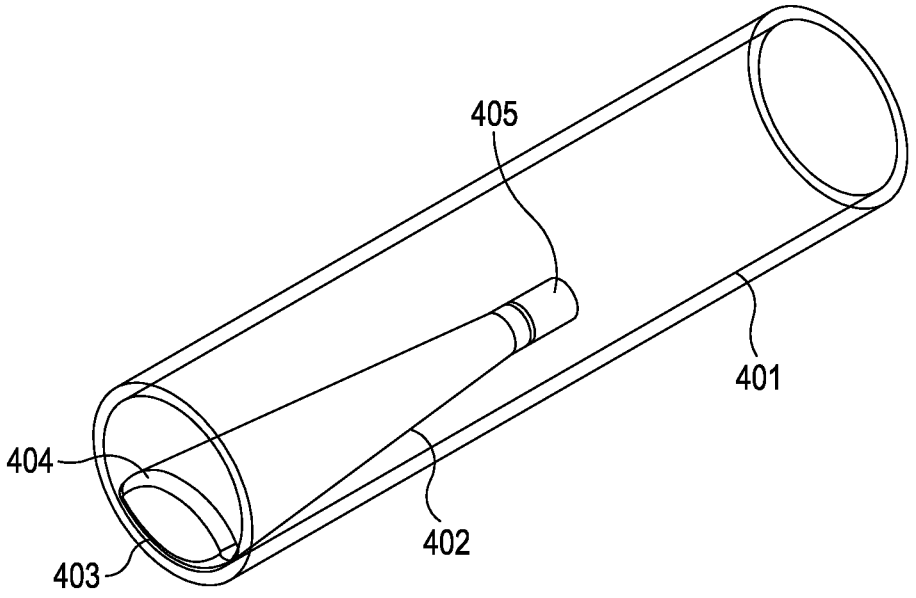
FIG. 4B illustrates a perspective view of an inlet device in a riser.

The inlet device (e.g. as shown in FIGS. 2A and 2B) is preferably in contact with the bottom wall of the riser. As described above, typically in the horizontal portion of the riser the fluids naturally stratify under the influence of gravity, creating a liquid-dominated phase flowing as a film along the bottom of the riser. The inlet device therefore is preferably arranged to be in contact with the bottom wall of the riser to extract this liquid film, without capturing the gas-dominated phase flowing above said film. FIGS. 4A and 4B show a specific example of a suitable inlet device 402, wherein the shape of the inlet device 402 is matched to a shape of the inner wall of the riser. FIG. 4A illustrates a radial cross section through a riser 401 in which the inlet device 402 is provided. FIG. 4B illustrates a perspective view of the inlet device 402. The downstream end 405 of the inlet device 402 is connected to the flexible tubing (not shown). In the longitudinal direction, the intake device 402 is tapered, with the widest point at the opening and the narrowest point at the end 405 joining the flexible tubing.

The inlet device 402 may be biased against the inner wall of the well by gravity. Alternatively, the inlet device 402 may be biased against the upper inside wall by a spacer, springs or other biasing means. The lower part 403 of the inlet device 402 at the upstream end has a curvature which matches the curvature corresponding to inner diameter D of the riser. As a result, the lower part 403 of the inlet device 402 is flush with the inner wall of the riser, such that a liquid phase which is present at the lower part of the riser will flow into the inlet device 402. In the example shown in FIGS. 4A and 4B, the upper part 404 of the inlet device 402 is curved. Alternatively, in some embodiments, the upper part is flat or concave so as to reduce the amount of gas flowing into the inlet device 402.

Figure 5A:
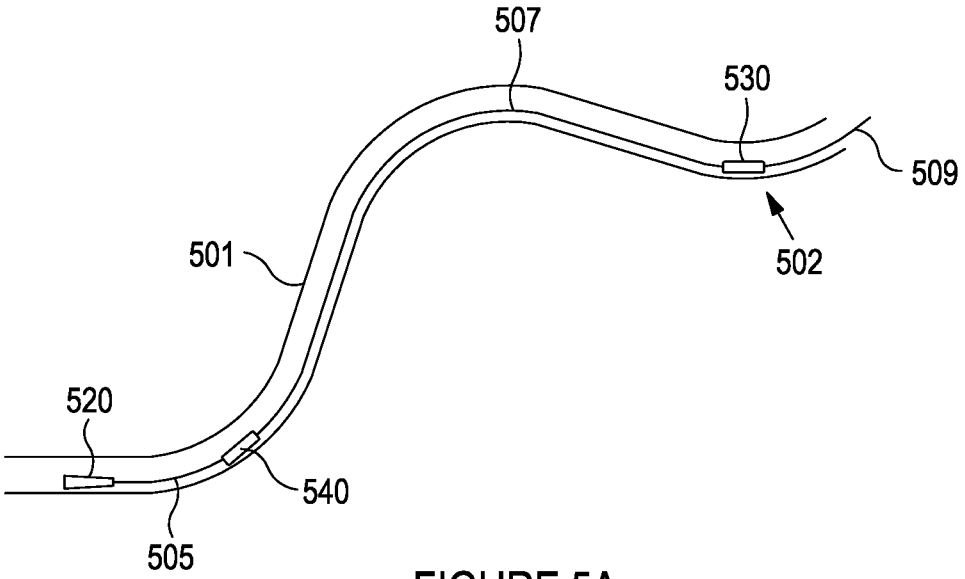
FIGS. 5A-D illustrate parts of a riser surge protection system.
Figure 5B:
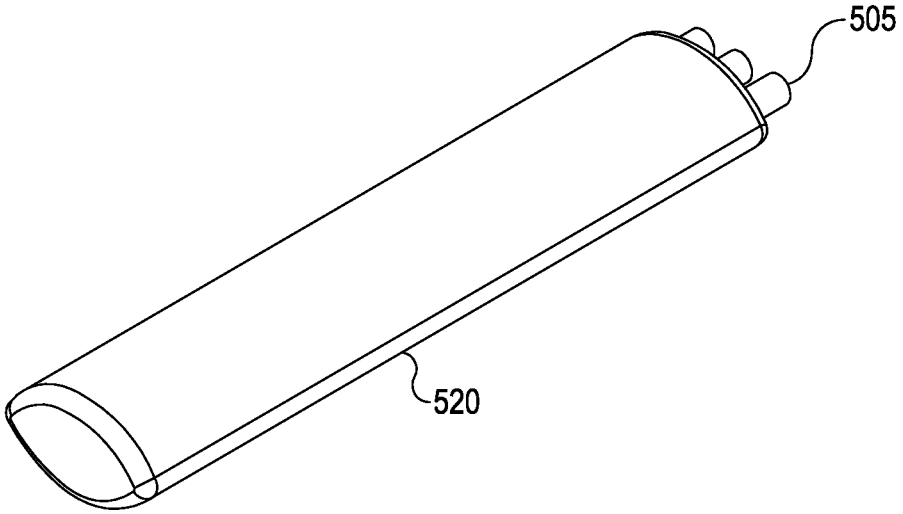
Figure 5C:
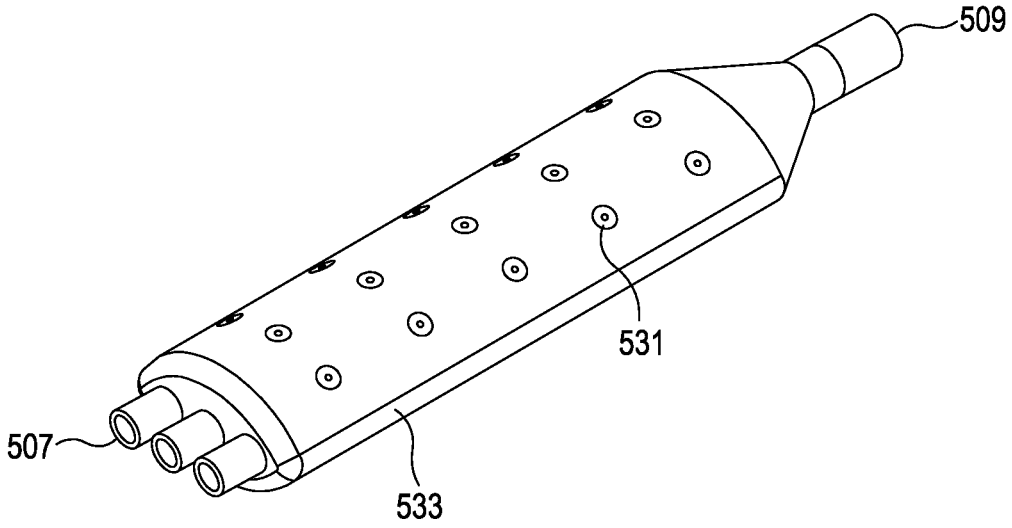
Figure 5D:
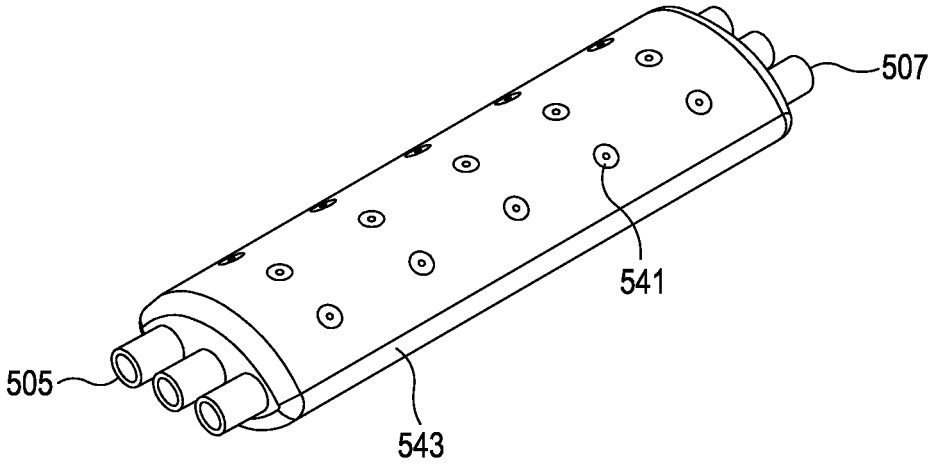

FIGS. 5A to 5D illustrate parts of a riser surge protection system, according to an embodiment of the invention. As above, the riser 501 is curved in an 'S'-shape, as shown in FIG. 5A. As with FIG. 2B, two groups of autonomous valves are provided in two different regions of the riser: a first group 531 in the minimum of sag bend 502 and a second group 541 in the first uphill section of the riser 501. The first group of autonomous valves 531 are provided within a first rigid supporting body 533, as shown in FIG. 5C. Likewise, the second group of autonomous valves 541 are provided within a second rigid supporting body 543, as shown in FIG. 5D. The inlet device 520 is shown in more detail in FIG. 5B. In this example, the rigid supporting bodies 533, 543 and inlet device 520 each have a curved cross-sectional shape, which is matched to the curvature of the inner wall of the riser.

If the hog bend is formed over a buoy or subsea arch having a relatively small diameter, the curvature of the riser 501 in the hog bend may be large. In this case, when the flexible tubing is passed over the hog bend, the tubing may become permanently deformed. The inventors have realised that a solution to this problem is to use multiple lengths of a smaller diameter tubing 505 to connect the inlet device 520 to the first supporting body 531, and the first supporting body 531 to second supporting body 543. In FIGS. 5A-D, three lengths of a smaller diameter (e.g. 2 inch) tubing 505 connect the inlet device 520 to the second supporting body 543. Likewise, three lengths of the smaller diameter tubing 507 connect the second supporting body 543 to the first supporting body 533. (These bundles of tubing have been illustrated as a single line in FIG. 5A for clarity.) The downstream end of the first supporting body 533 is connected to a larger diameter (e.g. 3.5-inch) tubing 509. In this way, the total cross-sectional area of the flexible tubing at each point along the length of the riser is kept approximately the same, but the problem of the tubing being deformed is mitigated.

Figure 6:
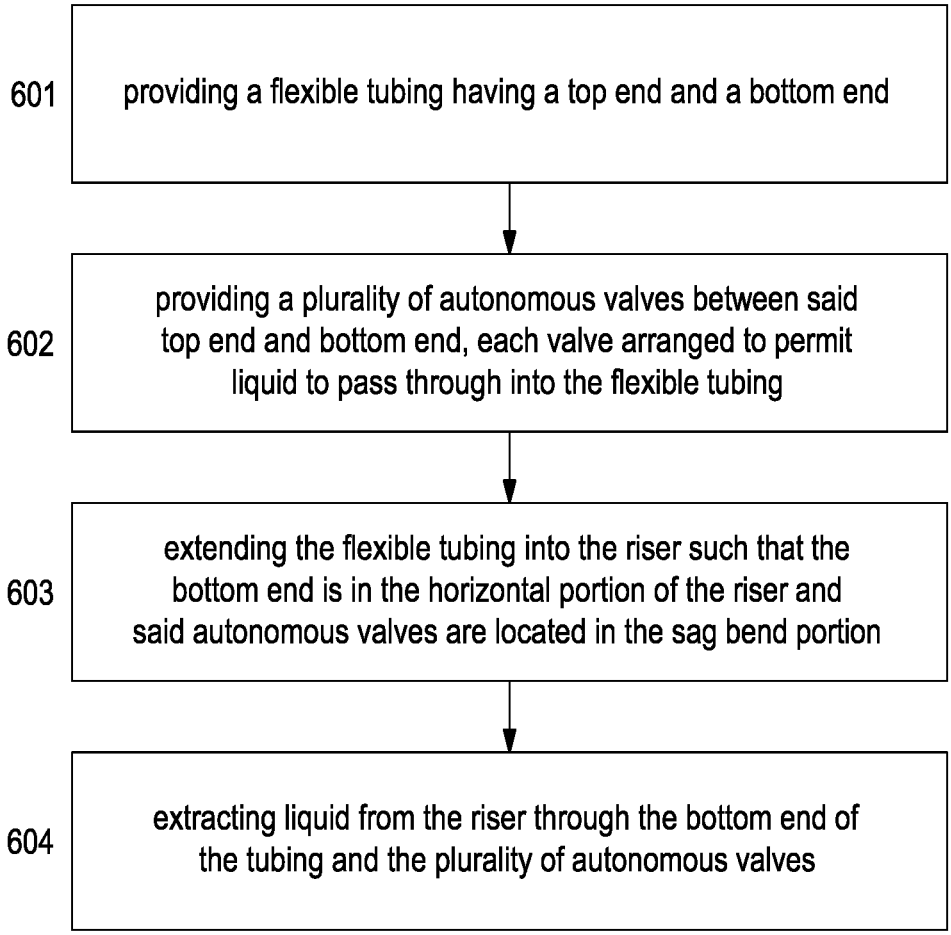
FIG. 6 illustrates a method according to an embodiment of the invention.

FIG. 6 shows a high-level flow diagram describing a method for protecting a riser against liquid surges in accordance with the invention. The method comprises providing a flexible tubing having a top end and a bottom end (step 601); providing a plurality of autonomous valves between said top end and bottom end, each valve arranged to permit liquid to pass through into the flexible tubing (step 602); extending the flexible tubing into the riser such that the bottom end is in the horizontal portion of the riser and said autonomous valves are located in the sag bend portion (step 603); and extracting liquid from the riser through the bottom end of the tubing and the plurality of autonomous valves (step 604).

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein

The invention claimed is:

1. A system for liquid surge protection of a subsea riser having a horizontal portion on the seabed and a sag bend portion, the system comprising:

a flexible tubing having a top end and a bottom end;

a plurality of autonomous valves configured to permit liquid to pass through into the flexible tubing, wherein the plurality of autonomous valves are arranged between the top end and the bottom end of the tubing, and wherein the plurality of autonomous valves are self-controlled and are arranged to selectively open or close depending on fluids which come in to contact with the plurality of autonomous valves; and an inlet device coupled to the bottom end of the flexible tubing, wherein said inlet device is biased against a bottom wall of the riser.

2. The system of claim 1, wherein the plurality of autonomous valves are arranged at a plurality of locations along the circumferential direction of the flexible tubing.

3. The system of claim 2, wherein the plurality of autonomous valves are arranged at a plurality of locations along the longitudinal direction of the flexible tubing.

4. The system of claim 1, wherein the plurality of autonomous valves are arranged at a plurality of locations along the longitudinal direction of the flexible tubing.

5. The system of claim 1, wherein the plurality of autonomous valves are provided within a wall of the flexible tubing.

6. The system of claim 1, wherein the plurality of autonomous valves are provided within a wall of one or more rigid supporting bodies attached to the flexible tubing.

7. The system of claim 6, wherein each of the one or more rigid supporting bodies has a curved shape which matches the inner curvature of the riser.

8. The system of claim 1, wherein the riser has a second sag bend portion, and wherein the system further comprises a second plurality of autonomous valves configured to permit liquid to pass through into the flexible tubing, wherein the second plurality of autonomous valves are arranged so as to be located in said second sag bend.

9. The system of claim 1, further comprising a pressure control system arranged to create a pressure differential between the riser and the flexible tubing.

10. The system of claim 1, wherein a top end of the riser is connected to a first separator and the top end of the flexible tubing is connected to a second separator, and wherein the second separator has a lower pressure than the first separator.

11. The system of claim 1, wherein in use the bottom end of the tubing is in the horizontal portion of the riser, and said autonomous valves are located in the sag bend portion.

12. The system of claim 1, further comprising a spacer or a weight arranged to urge the inlet device against the bottom wall of the riser.

13. The system of claim 1, wherein the inlet device has a curved shape which matches the inner curvature of the riser.

14. The system of claim 1, further comprising a reel for unreeling the flexible tubing to extend said flexible tubing into the riser.

15. A method for liquid surge protection of a subsea riser having a horizontal portion on the seabed and a sag bend portion, the method comprising:

providing a flexible tubing having a top end and a bottom end;

providing a plurality of autonomous valves between said top end and bottom end, each valve arranged to permit liquid to pass through into the flexible tubing, wherein the plurality of autonomous valves are self-controlled and are arranged to selectively open or close depending on fluids which come in to contact with the plurality of autonomous valves;

extending the flexible tubing into the riser such that the bottom end is in the horizontal portion of the riser and said autonomous valves are located in the sag bend portion; and extracting liquid from the riser through the bottom end of the tubing and the plurality of autonomous valves.

16. The method of claim 15, wherein before extracting liquid from the riser through the bottom end of the tubing and the plurality of autonomous valves, the method further comprises:

creating a pressure differential between the riser and the flexible tubing.

* * * * *